United States Patent [19]

Hanyu et al.

[11] Patent Number: 4,623,275

[45] Date of Patent: Nov. 18, 1986

[54] SHIFTING MECHANISM FOR A SINTERED-BODY PLATEN IN A DOT-MATRIX IMPACT PRINTER

[75] Inventors: Susumu Hanyu; Hideaki Takenoya, both of Tokyo; Fumiyuki Mishima, Hino, all of Japan

[73] Assignee: Janome Sewing Machine Co., Ltd., Tokyo, Japan

[21] Appl. No.: 610,872

[22] Filed: May 16, 1984

[30] Foreign Application Priority Data

May 27, 1983 [JP] Japan ..... 58-92427

[51] Int. Cl.[4] ..... B41J 27/06; B41J 3/12

[52] U.S. Cl. ..... 400/662; 400/124; 400/470; 400/649

[58] Field of Search ..... 400/124, 470, 471, 471.1, 400/662, 649

[56] References Cited

U.S. PATENT DOCUMENTS 4,210,917 7/1980 Lane, III ..... 400/470
4,386,861 6/1983 Kurihara et al. ..... 400/124

FOREIGN PATENT DOCUMENTS 56-33972 4/1981 Japan ..... 400/144.2
58-107380 6/1983 Japan ..... 400/470

OTHER PUBLICATIONS

"Color Wheel w/Inked Platens", *IBM Technical Disclosure Journal;* vol. 25, No. 4, p. 2193; Sep. 1982; F. R. Humphreys.

*Primary Examiner*—Edgar S. Burr
*Assistant Examiner*—David A. Wiecking
*Attorney, Agent, or Firm*—Michael J. Striker

[57] ABSTRACT

The printing mechanism of a dot matrix printer includes a platen provided on its jacket with elongated ink impregnated sintered bodies each extending over the entire length of the platen. The platen is movable in the printing direction at one side of a printing paper. A printing head moves in the same direction but at a different speed at the opposite side of the paper so that impact wires strike different points on a preselected sintered body during the printing of a line.

3 Claims, 2 Drawing Figures

SHIFTING MECHANISM FOR A SINTERED-BODY PLATEN IN A DOT-MATRIX IMPACT PRINTER

BACKGROUND OF THE INVENTION

This invention relates to a printer of dot matrix impact type, and more particularly to an improved printer which changes a relative position between a platen and a printing head for realizing desired printings.

Known is a printer which guides a paper sheet between a printing head and a platen provided with sintered bodies made of nylon impregnated with inks. This kind of the printer is difficult to manufacture because requirements on precision of the platen having a long printing part.

Known is also a printer of this type for printing on a paper of large width, which does not use a platen having a large printing part extending over the full width of the paper, but uses a platen of comparatively short length to be synchronized with a printing head and moved at equal speed therewith.

The printer of this type which moves the platen and the printing head at the equal speed, especially the printer having the printing head of a wire dot matrix impact type, encounters the following problems.

When the sintered bodies of the platen are impacted by means of wires striking against the printing paper sheet, the surface of the sintered bodies becomes deformed and depressed. The depression caused by one impact is recovered, but if the same surface is repeatedly impacted, the depression will not recover and the sintered bodies develop non-uniformity on the surface. If the printing is continued, the corresponding part of the paper would be excessively depressed and holes would result. The depressed part caused by the successive imparts delays supplying the ink, or makes the printing ink light.

SUMMARY OF THE INVENTION

This invention is to provide a printer which guides a printing paper sheet between the printing head and a platen having a plurality of sintered bodies impregnated with inks, and carries out printing by the action of impact wires of the printing head, whereby during the printing the platen and the printing head keep changing their relative position in the direction of a printed line, thereby to remove the above mentioned disadvantages of the prior art.

DETAILED DESCRIPTION OF THE INVENTION

Figure 1:
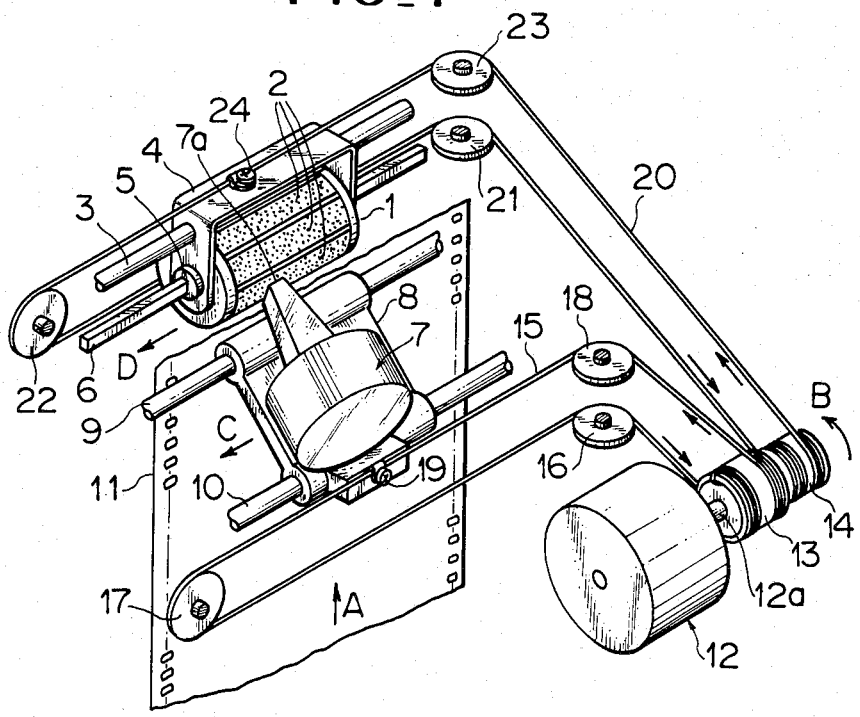
FIG. 1 is a perspective view showing a major part of a printing mechanism according to the invention.

The invention will be explained with reference to an embodiment shown in an accompanied drawing. In FIG. 1, a platen 1 is provided on its jacket with a plurality of elongated sintered bodies 2 which are, in this embodiment, impregnated with inks of different colors. Each sintered body 2 extends substantially over the entire length of the platen 1. The platen 1 is rotatably supported on a bearing 5 of a holder 4 slidable on a shaft 3. The platen 1 with the bearing 5 is slidable on a square shaft 6, and is rotated by rotation of the shaft 6 so that a printing color is selected. The platen 1 is moved together with the holder 4 and the bearing 5 along the shafts 6 and 3.

A printing head 7 is provided on a carriage 8 which is slidable on guide shafts 9, 10. The printing head 7 is a dot impact type having a plurality of impact wires arranged in a pointed end *7a* of the head.

A printing paper 11 is fed in a direction of arrow A and is guided between the platen 1 and the impact wires *7a* of the head 7, and the printing is made on the platen side of the paper 11.

A shaft *12a* of a motor 12 is provided with pulleys 13 and 14. The pulley 13 is larger in diameter than the pulley 14. The pulley 13 is wound with end parts of a cable or wire 15 as shown in FIG. 1, both ends of of the wire 15 being secured thereon, while an intermediate part of the wire 15 runs on rollers 16, 17 and 18. The intermediate part of the wire 15 is connected to the carriage 8 by a screw 19 or the like. The pulley 14 is similarly wound with end parts of a cable or wire 20, both ends of which are secured thereon, while the intermediate part of the wire 20 runs on rollers 21, 22 and 23. The intermediate part of the wire 20 is connected to the holder 4 by a screw 24 or the like.

Accordingly, if the shaft *12a* of the motor 12 is rotated in a direction of arrow B, the intermediate parts of wires 15 and 20 are wound on the pulleys 13 and 14, and concurrently the end parts of the wires are unwound by the same amount as the winding amount. The head 7 and the platen 1 are moved in directions indicated by arrows C and D, respectively. Since the pulley 13 is, as said above, larger in diameter than the pulley 14, the head 7 is moved faster than the platen 1, thereby providing relative movement therebetween.

Figure 2:
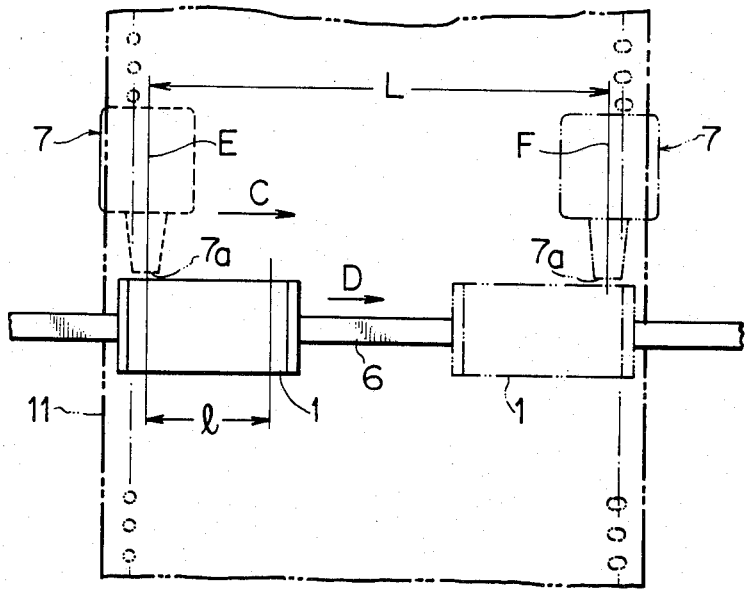
FIG. 2 is a view for explaining a relative position between a head, platen and a printing paper.

For printing on the paper 11 from the left to the right in FIG. 2, adjustment is made by means of the screw 19 such that a position E of the paper 11 is the leftmost printing position, and the pointed ends of impact wires *7a* of the head 7 are moved to this position.

The ratio of the diameters of the pulleys 13 and 14 are determined such that if the motor 12 is rotated in the direction of arrow B in FIG. 1 under the above mentioned condition, the head 7 and the platen 1 are moved in the directions of arrows C and D until the head 7 comes to a position F which is the rightmost printing position of the paper 11.

Assuming that the maximum printing width of the paper 11 is "L" and the printing width of the platen 13 is "l", the ratio of the pulleys 13 and 14 is $L/(L-l)$.

In the present embodiment, one motor is used and the relative movement is provided by changing the diameters of the pulleys, but it is possible to provide the relative movement by means of two separate motors for the head and the platen.

Operation of the embodiment according to the invention will be explained. When the motor 12 is rotated in the direction of arrow B, the head 7 and the platen 1 are moved in the directions of arrows C and D, and during their movement the relative movement results.

Therefore, when one line is being printed, the impact position of the head 7 relative to an elongated sintered body 2 on the platen 1 keeps changing in the printed line, and since the same point is not impacted, the corresponding sintered body 2 of the platen 1 is not repeatedly striken on the portion having depressions due to the preceding impact at least until the head 7 comes to a subsequent line of characters to be printed.

Since the depression is recovered and the ink is supplied to the sintered bodies, the before described disadvantages of the prior art are removed, namely abnormal depressions at the printed part of the paper, holes pierced in the paper, too light printing color, or a non-uniform color.

Further, according to the invention, the length of the sintered body 2 of the platen 1 can be shorter than the width of the printing paper, and the short platen 1 can be processed at high precision.

We claim:

1. A printing mechanism of a dot impact-type printer, comprising a platen movable in a printing direction along a predetermined printing line at one side of a printing paper; a printing head arranged for movement in said printing direction along the printing line at the opposite side of the paper, said platen provided on its jacket with a plurality of elongated, ink impregnated sintered elements each extending parallel to said printing line and each extending substantially over the entire length of said platen, said printing head imparting through the paper dot impacts against one of said elongated ink impregnated sintered elements to print characters on the paper during its movement; drive means including first rotational means coupled to said platen to move the same in said printing direction at a first predetermined speed, and second rotational means coupled to said printing head to move the same in said printing direction at a second predetermined speed.

2. A printing mechanism as defined in claim 1, wherein said drive means includes a single reversible motor, and wherein said first rotational means includes a first pair of pulleys rotated by said single reversible motor and each having a diameter of a predetermined dimension, said second rotational means includes a second pair of pulleys rotated by said single reversible motor and each having a diameter of a dimension different from that of said first pair of pulleys.

3. A printing mechanism as defined in claim 2, wherein said drive means further includes first transmission means including a first wire having an intermediate portion thereof connected to said platen, one end connected to one of said first pair of pulleys and the other end connected to the other of said first pair of pulleys, and second transmission means including a second wire having an intermediate portion thereof connected to said printing head, one end connected to one of said second pair of pulleys and the other end connected to the other of said second pair of pulleys.

* * * * *